United States Patent [19]

Melcher et al.

[11] 4,038,052

[45] July 26, 1977

[54] APPARATUS FOR ELECTRICAL SUPPORT AND STABILIZATION OF STATIC, PACKED, AND FLUIDIZED BEDS

[75] Inventors: James R. Melcher, Lexington, Mass.; Thomas W. Johnson, Yellow Springs, Ohio

[73] Assignee: Massachusetts Institute of Technology, Cambridge, Mass.

[21] Appl. No.: 516,056

[22] Filed: Oct. 18, 1974

[51] Int. Cl.[2] ..... B03C 3/01; B03C 3/45; F15C 1/04

[52] U.S. Cl. ..... 55/138; 23/284; 34/1; 55/155; 55/428; 55/494; 55/512; 137/827

[58] Field of Search ..... 55/107, 131, 138, 143, 55/145, 150, 154, 390, 155, 428, 474, 512, 518, 91, 98, 99, 494; 137/807, 803, 825, 827; 23/284; 34/1

[56] References Cited

U.S. PATENT DOCUMENTS

| | | | |
|---|---|---|---|
| 2,689,973 | 9/1954 | Lee et al. | 55/474 UX |
| 2,990,912 | 7/1961 | Cole | 55/154 X |
| 3,365,858 | 1/1968 | Penney | 55/138 X |
| 3,405,728 | 10/1968 | Dexter | 137/251 |
| 3,424,674 | 1/1969 | Webber | 55/474 UX |
| 3,548,852 | 12/1970 | Fisher | 137/827 X |
| 3,599,428 | 8/1971 | Chaney et al. | 137/827 X |

FOREIGN PATENT DOCUMENTS

| | | | |
|---|---|---|---|
| 96,717 | 9/1939 | Sweden | 55/107 |

*Primary Examiner*—Frank W. Lutter
*Assistant Examiner*—Kathleen J. Prunner
*Attorney, Agent, or Firm*—Arthur A. Smith, Jr.; Robert Shaw; Martin M. Santa

[57] ABSTRACT

Apparatus for effecting the function conventionally performed by the distributor plate in static, packed, or fluidized beds wherein the bed particles are supported or stabilized by an electric field imposed by an external source of electric potential.

20 Claims, 7 Drawing Figures

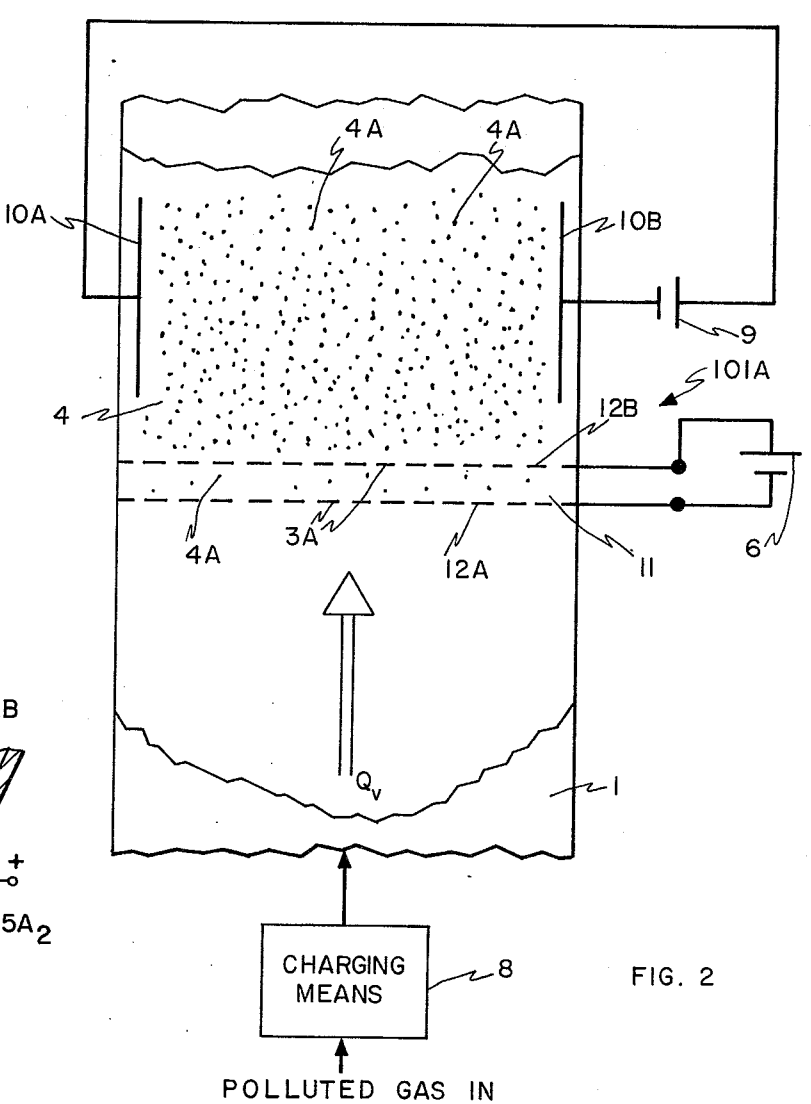
FIG. 2
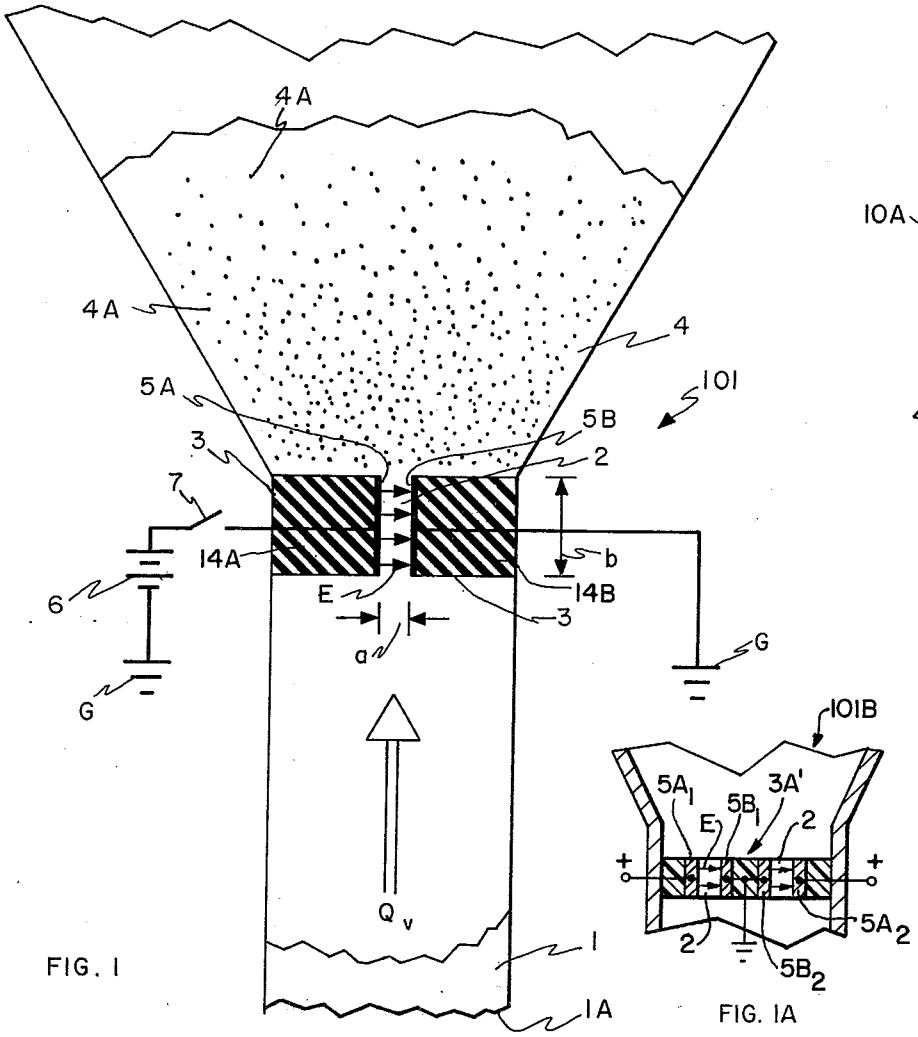
FIG. 1
FIG. 1A

APPARATUS FOR ELECTRICAL SUPPORT AND STABILIZATION OF STATIC, PACKED, AND FLUIDIZED BEDS

The present invention relates to electromechanical distributor plates and the like for static, packed or fluidized beds.

In a conventional packed bed system or a fluidized bed system, it is often necessary to provide a support grid or distributor plate that holds the bed particles in the bed region against the force of gravity.

Such is the case of the systems hereinafter discussed wherein air or other gas is admitted into and through the bed region, whether the system employs a packed bed or a fluidized bed. The air passing through the bed first passes through a duct substantially free of bed particles, then through the distributor plate or support grid into the bed region. Thus the bed support grid must allow the air to pass with a minimum pressure drop while at the same time preventing the leakage of bed particles downward. Such bed support grids or distributor plates are described in the existing literature of packed beds and fluidized beds. For example, see *Fluidization* by J. F. Davidson and D. Harrison, Academic Press, New York 1971. To achieve the low leakage rates of particles desired in some situations it is necessary to sustain an undesirably high pressure drop across the distributor plate.

An object of the present invention is to provide a distributor plate and the like for packed and fluidized beds, which contains means for preventing the leakage of particles from the bed while having, nevertheless, a relatively low pressure drop through the distributor plate.

Another object is to provide convenient means for controlling leakage of particles from the bed so that by simply removing or applying electrical energization the distributor plate functions effectively as a valve allowing or preventing the removal or leakage of particles.

Another object is to provide a distributor plate or a valve of more general use.

These and other objects are evident in the description that follows and are particularly pointed out in the appended claims.

The foregoing objects are achieved in a distributor plate or the like which provides electromechanical support for bed particles of a static bed, fluidized bed or a packed bed and that includes a perforated or apertured member disposed below the bulk of the bed having at least one perforation or aperture, said at least one perforation or aperture being much larger than the bed particles so that, in the absence of measures to prevent such, the bed particles would drop through the perforation or aperture; and means to create an electric field of sufficient intensity in the perforation or aperture so that the charged bed particles, though smaller than the perforation in physical size, do not fall through the perforation or aperture by virtue of the influence of the intense field upon the particles.

The invention hereinafter is described with reference to the accompanying drawing in which:

FIG. 1 is a schematic elevation view, partly cutaway, of a packed bed system or fluidized bed systems with a slit orifice fitted with electrodes for supporting or stabilizing the bed in a cross-flow configuration;

FIG. 1A is a cross-section similar to the cross-section of FIG. 1 but showing a multi-apertured plate.

FIG. 2 is a schematic elevation view, partly cutaway, of apparatus in which the electrodes constituting a distributor plate impose a field in the co-flow configuration;

Figure 3B:
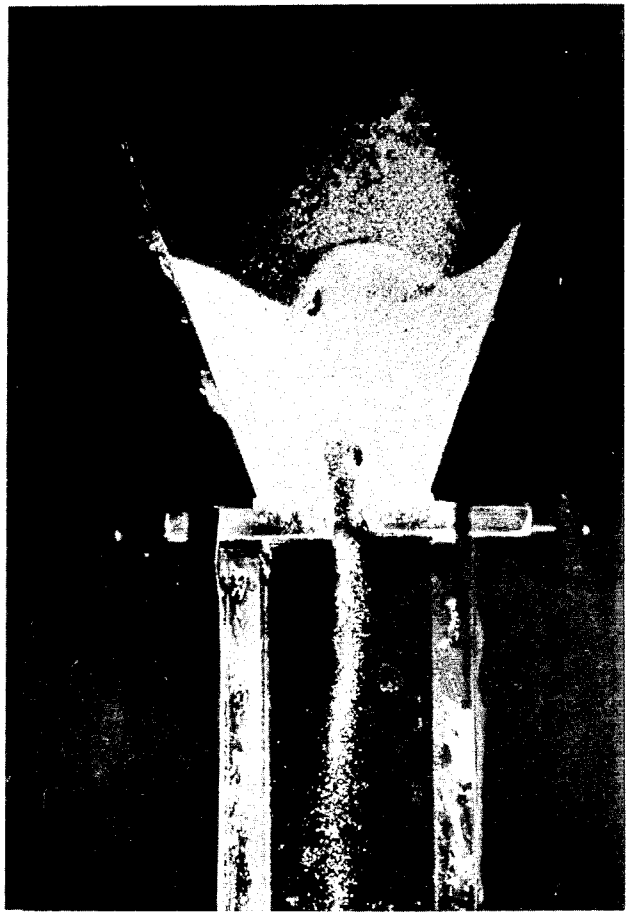
Figure 3A:
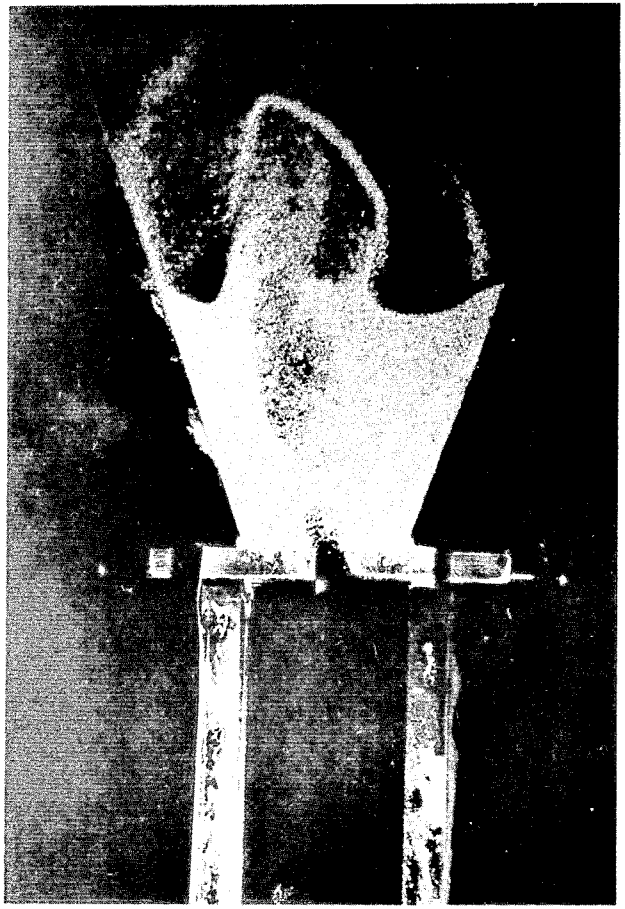
Figure 4B:
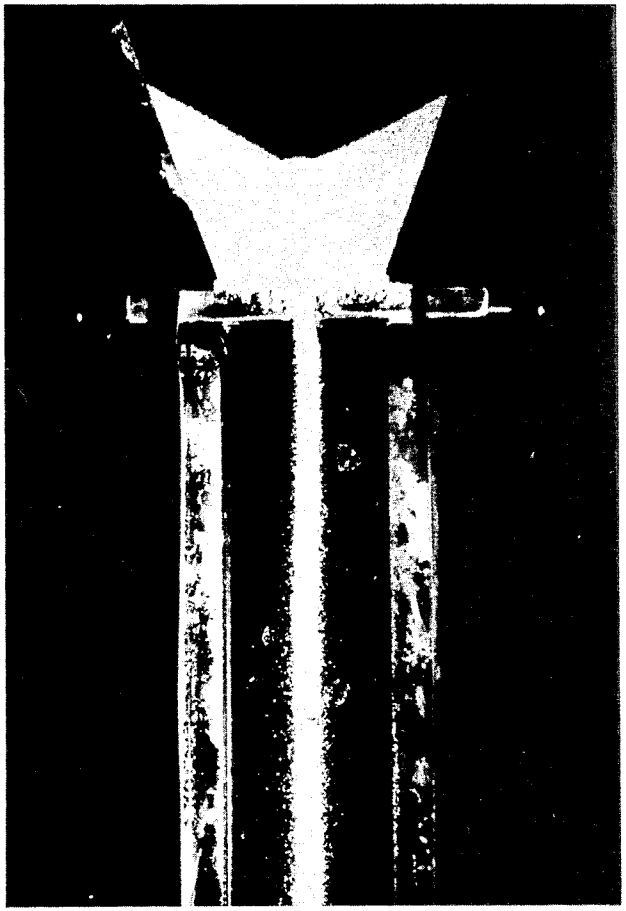
Figure 4A:
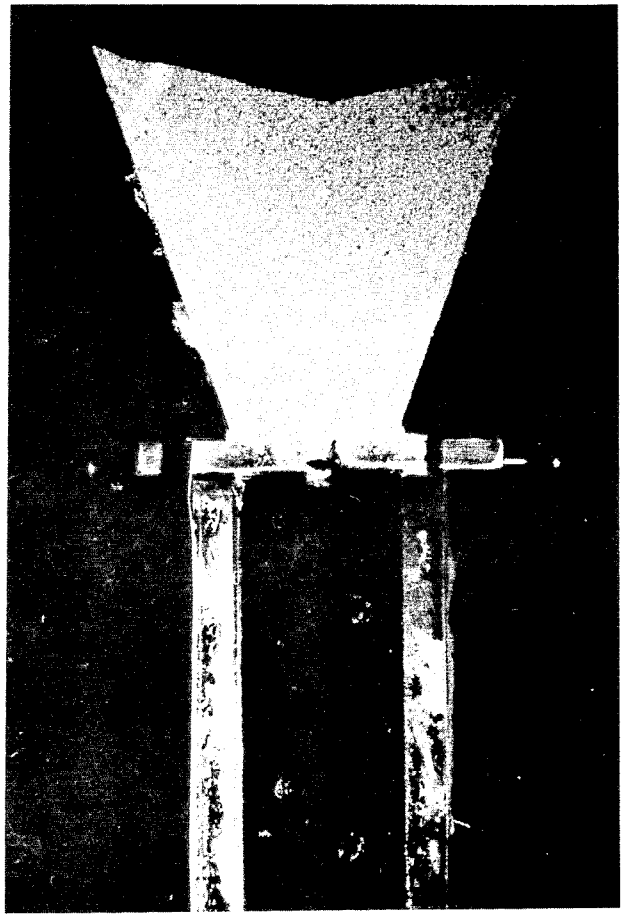

FIGS. 3A and 3B show a cross-flow slit orifice stabilizing an actual fluidized bed, an electric field being applied in the system of FIG. 3A with the result that there is no leakage of particles from the bed while in FIG. 3B the electric field has been removed and the particles can be seen to drain from the bed; and FIGS. 4A and 4B show a packed bed supported by a cross-flow single orifice distributor plate, an electric field being imposed in the system of FIG. 4A and there being no leakage of particles from the bed while in FIG. 4B the field has been removed and the particles are falling freely through the orifice.

Before giving a detailed description of the present invention, some preliminary remarks are in order. The invention is concerned, for example, with electromechanical means for supporting particles. Such particles may be in the form of an electrofluidized bed as is discussed in an application for Letters Patent entitled "Electrofluidized Beds for Collection of Particulate" (Melcher et al), Ser. No. 516,057, filed Oct. 18, 1974 that accompanies herewith and that is assigned to the same assignee as the present application; in the system therein disclosed, polluted air passes through a support grid or distributor plate and then to the electrofluidized bed wherein particulate is removed The air acts to fluidize the bed particles and it is cleaned by the particles. One aspect of the instant invention is to provide a novel support grid or distributor plate for such a bed, but the invention is not restricted in use to electrified beds or to fluidized beds, as is hereinafter noted.

In successfully using electric fields to support or stabilize fluidized (or packed or static) beds it is essential to recognize the key role played by the electrical conductivity of the bed particles. Conduction of electrical current through some particles can be characterized by a bulk particle conductivity but more likely for the particles of interest here conduction occurs on the surface of relatively insulating particles. For example, if ordinary sand is used (e.g., the fluidized bed of said application Ser. No. 516,057), electrical conduction is largely determined by the relative humidity and hence occurs on the surface of the sand particles. What is important to the successful operation of an electrical distributor plate is the charge relaxation time of the bed particles, that is, the time required for the particle to acquire a significant electrical charge when contacting a metallic electrode in an ambient electric field.

If the bed particles are very highly insulating their electromechanical response to an imposed electric field is largely determined by relatively uncontrolled factors such as frictional electrification. On the other hand, if the particles are too highly conducting, electrical breakdown or at least electrical heating will pose a limitation on the fields that can be used.

Optimal electrical relaxation times for the bed particles are shorter than a tenth of a second and longer than ten microseconds. Because the electrical relaxation time of the particles (i.e., the time required by the particles to acquire a significant electrical charge upon contacting a metallic electrode) is the key factor in the present invention, any particles having an electrical relaxation time within the optimal range (i.e., between 10 microseconds and a tenth of a second) will operate satisfactorily. Sand is an example of suitable particles. There are other suitable particles however, and these are designated hereinafter as "semi-insulating" particles. That is to say, the term semi-insulating particles means particles having an electrical relaxation time within the optimal range, and includes particles, which in other environments or applications, may be considered as being relatively insulating or relatively conducting.

The imposed electric field that supports or stabilizes the bed can be in one of two possible configurations (i.e., cross-flow and co-flow) or some combination of these configurations. In the cross-flow configuration the electric field is imposed in a substantially horizontal direction and so is perpendicular to the direction of the gas flow. In the co-flow configuration the electric field is imposed in a substantially vertical direction and hence in the same direction as the gas flow.

The electric field functions to prevent leakage of particles from the bed in two possible ways. If the bed is packed, the electric field causes the particles to form strings between the electrodes that allow the particles to be retained between the electrodes because of electrically induced adhesion to the walls and to each other. In the case of a fluidized bed with a fluidizing vertical velocity, the electric field can be used simply to stabilize the bed with the upward-flowing fluid serving to support the particles in an average sense. In such a fluidized bed the distributor plate orifices or perforations are usually limited in size because particles tend to slip downward through the boundary layers where the upward gas velocity is not sufficiently large to levitate the particles. With the electric field applied to electrodes bounding the orifice, a particle passing through the boundary layer contacts the electrode, becomes charged, and is forced into the mainstream by the resulting electrical force so that it is carried back upward into the bulk of the bed above. Depending upon the relative flow rate, the electrical distributor plate will function to prevent leakage through one or the other or a combination of these mechanisms.

Turning now to FIG. 1, the apparatus labeled 101 consists of a duct 1 through which a fluid (gas) can flow at some rate $Q_V$, through an aperture 2 in an apertured member or plate 3 and, thence to a fluidized or a packed bed 4 comprising particles 4A. The aperture 2 is a slitted orifice having a width *a*, some length *l* into the paper, (typically $l > a$) and a thickness *b*. The plate aperture 2, as shown, has cross dimensions (i.e., *a* and *l*) that are much larger than the cross dimensions of the particles 4A, so that, in the absence of measures to prevent such, the bed particles would drop through the aperture 2 and thereby deplete the bed. To prevent escape of the particles, means is provided for creating an electric field E (here a cross-flow configuration) in the perforation or aperture 2 so that the bed particles, though smaller than the perforation or aperture 2 in physical size, as above explained, do not pass through the perforation or aperture by virtue of the influence of the field E upon the particles.

Plate 3 comprises a pair of spaced insulators 14A and 14B respectively carrying electrodes 5A, 5B which face each other in spaced relationship and define aperture 2. Electrodes 5A and 5B constitute means for creating the transverse electric field E across aperture 2 shown in FIG. 1 when a d-c (or a-c) source of electric potential 6 is connected to the electrodes through switch 7. The bed 4, as indicated, can be fluidized or it can be a packed bed wherein the air or other fluid performs a drying function, a chemical or some other function, with or without an imposed field in the bulk of the bed; also, the bed 4 can be merely static, wherein particles 4A are stored in bulk and the electromechanical device comprising the plate 3, the electrodes and the potential source 6, acts as an electric valve, as hereinafter shown, either to pass or obstruct passage of the particles. In actual apparatus similar to FIG. 1 and, in fact, pictured in FIGS. 3A–4B hereof, the slit dimensions are: $a=0.47$ cm, $b=1.25$ cm, and $l=3.80$ cm; and the voltage of the source 6 is 9kV.

The apparatus shown at 101A in FIG. 2 includes a distributor plate 3A in the co-flow configuration. The system 101A is particularly directed to the cleaning of polluted gas as discussed in said application Ser. No. 516,057 and includes charging means 8 to charge particulate in the incoming dirty air. The fluidizing gas passes upward through the duct, again labeled 1, through the distributor region shown at 11 between the screen-like first and second electrodes 12A and 12B, respectively (i.e., the electrodes 12A and 12B are planar in form and each has a plurality of apertures 2 therethrough, as shown in FIG. 2; and the electrodes 12A and 12B are disposed substantially orthogonal to the axis of the duct 1.) that form the distributor plate 3A and thence, into the bed 4 wherein, here, the bed particles 4A are electrically stressed by electrodes 10A and 10B connected to a d-c (or a-c) source 9, the particulate being removed from the air by agglomeration upon the bed particles. The pair of screen-like electrodes are charged by a potential source that is again numbered 6.

In either the cross-flow configuration or the co-flow configuration the bed may consist of packed particles or fluidized particles, as noted above. In the cross-flow configuration the distributor plate can consist of a multiplicity of electrode pairs, as shown in FIG. 1A, so that the gas passes upward through slits or slit-like orifices in parallel.

The system labeled 101B in FIG. 1A is identical to the system 101 in FIG. 1 except that in the system 101B the apertured plate shown at 3A' comprises a plurality of apertures 2 therethrough respectively between electrode pairs $\mathbf{5A_1}$–$\mathbf{5B_1}$ and $\mathbf{5A_2}$–$\mathbf{5B_2}$; the electrodes $\mathbf{5A_1}$ and $\mathbf{5A_2}$, as shown, are at (+) potential and the center electrodes $\mathbf{5B_1}$ and $\mathbf{5B_2}$ are grounded.

The cross-flow, single slit orifice plate in FIGS. 3A and 3B functions as a valve. The particles there are 1mm in diameter sand with the relative humidity being 98%. In FIG. 3B the potential has been removed and the particles fall relatively freely through the slit. In the case depicted in FIGS. 3A and 3B, the bed support comes from the fluidizing air while the field serves to stabilize the bed against loss of particles through the slit boundary layers.

In FIGS. 4A and 4B, the bed is packed and there is no upward gas flow. In FIGS. 4A a voltage of 9 kV has been applied across the slit orifice and there is no loss of particles. In FIG. 4B the field has been removed and the particles fall freely through the slit. Similar performance can be obtained by placing the slits in parallel or by making the slits from concentric coaxial electrodes. These and other modifications of the invention will occur to those skilled in the art and all such modifications are considered to be within the spirit and scope of the invention as defined by the appended claims.

What is claimed is:

1. A particle bed system that comprises: a duct through which a gas can flow; a particle bed spanning the duct, through which the gas flows, the individual particles being semi-insulating; and electromechanical support means that comprises a grid having a plurality of apertures therethrough disposed in the duct below the particle bed such that the gas must flow through the apertures in the grid before flowing into and through the particle bed, said apertures being much larger than individual particles of the particle bed so that, in the absence of measures to prevent such, the bed particles would drop through the apertures and deplete the particle bed, and means connected to the grid to create an electric field in the apertures of sufficient intensity so that the bed particles, though smaller than the apertures in physical size, do not pass through the apertures by virtue of the influence of the electric field upon the particles.

2. A particle bed system according to claim 1 in which the electric field in the apertures is in the cross-flow configuration, that is, the field direction is substantially perpendicular to the flow direction of the gas in the apertures.

3. A particle bed system according to claim 1 in which the grid comprises a pair of conductive screens spaced one from the other in the direction of the gas flow, the interstices of the screens defining said apertures, said means connected to the grid for creating an electric field between the screens in a direction substantially parallel to the flow direction of the gas.

4. A particle bed system comprising: a particle bed adapted to have a gas pass therethrough, and having semi-insulating particles; and electromechanical means to support the particle bed, said electromechanical means having, in combination, an apertured member disposed below the bed and having at least one aperture therethrough, said at least one aperture being much larger in cross dimensions than the particles of the particle bed so that, in the absence of measures to prevent such, the bed particles would drop through the aperture, and means connected to the apertured member to create an electric field in said at least one aperture of sufficient intensity in the aperture that the bed particles, though smaller in physical size than the aperture, do not fall through the aperture at least in part by virtue of the influence of the intense field upon the particles.

5. Apparatus as claimed in claim 4 in which the apertured member comprises electrode means, and in which the means connected to the apertured means to create an electric field includes electric potential means connected to energize the electrode means and create a field across said at least one aperture, at least one cross dimension of said at least one aperture being limited so that the field intensity is sufficient to prevent passage of particles therethrough.

6. Apparatus as claimed in claim 5 in which the electrode means comprises a pair of spaced electrodes that face each other and define said at least one aperture, so as to provide, when energized, an electric field in a direction transverse to the spaced electrodes.

7. Apparatus as claimed in claim 5 wherein the apertured member contains a plurality of apertures thereby forming a grid which electromechanically supports the particle bed, and the electrode means comprises a plurality of pairs of spaced electrodes, each electrode of a pair facing the other and defining the apertures.

8. Apparatus that includes the grid of claim 7 in combination with a duct in which the grid is mounted, the duct being adapted to receive the gas which passes through the duct, and then through the apertures in the grid and thence to the particles of the bed.

9. Apparatus as claimed in claim 8 that further includes means to charge electrically the particles of the bed.

10. Apparatus as claimed in claim 4 in which the apertured member comprises electrode means for supporting the bed and in which the electrode means comprises a pair of closely spaced screen-like electrodes, each electrode comprising many apertures, the electrodes being spaced from one another.

11. Apparatus that includes the pair of screen-like electrodes of claim 10 disposed transversely in a duct, each of the screen-like electrodes being substantially planar and being disposed substantially orthogonal to the axis of the duct which is adapted to receive the gas that passes through the duct, through the apertures of the screen-like electrodes and, thence to the particles of the bed.

12. Apparatus as claimed in claim 11 that further includes means to impose an electric field upon the particles of the bed thereby to charge the same.

13. Apparatus for electrostatically inducing agglomeration to enhance particulate removal from a gas, that comprises: a duct through which the particulate-carrying gas can flow; means for charging the particulate in the duct; a fluidized bed in the duct comprising semi-insulating particles through which the gas flows; a distributor plate to provide electromechanical support for the bed particles, said distributor plate comprising a grid having a plurality of apertures therethrough, the grid having cross dimensions essentially the same as the cross dimensions of the duct and being disposed in the duct such that the gas must flow through the apertures, said apertures being much larger than the bed particles so that, in the absence of measures to prevent such, the bed particles would drop through the apertures and deplete the bed; means to create an electric field in the apertures of the grid so that the particles making up the bed, though smaller than the apertures in physical size, do not pass through the apertures by virtue at least in part of the influence of the field upon the particles; and means associated with the bed for imposing an electric field upon the particles of the bed to create an electrofluidized bed, said charged particulate being electrically attracted by the charged surfaces of the particles of the electrofluidized bed and collected upon the particles of the electrofluidized bed.

14. Apparatus as claimed in claim 13 in which the bed particles have a relaxation time which is less than the order of one-tenth of a second and larger than about 10 microseconds.

15. Apparatus that comprises, in combination, a bed comprising many semi-insulating particles; and an electromechanical valve to effect valving of the particles, said electromechanical valve including, in combination, a member having an aperture therethrough that is much larger in cross dimensions than the cross dimensions of an individual particle, and means to create an electric field in the aperture, the electric field acting to prevent passage of particles through the aperture and being of sufficient intensity to effect prevention of such passage.

16. Apparatus that comprises, in combination:

a bed containing small bed particles of semi-insulating material;

electromechanical support means that holds the bed particles against the force of gravity, said electromechanical support means comprising apertures through which a gas can flow into the bed in a direction opposite to the direction of the force of gravity, the apertures being much larger than the bed particles so that, in the absence of measures to prevent such, the bed particles would drop through the electromechanical support means and deplete the bed; and electrical potential means connected to energize the electromechanical support means to create an electric field across the apertures so that the bed particles, though smaller than the apertures in physical size, do not pass through the electromechanical support means, due to the force of gravity, because of the influence of the electric field upon the particles.

17. Apparatus as claimed in claim 16 wherein the electromechanical support means is in a cross-flow configuration wherein the electric field is imposed in said apertures in a direction that is substantially perpendicular to the direction of gas flow, said apertures being small enough so that the field intensity prevents leakage.

18. Apparatus as claimed in claim 16 wherein the field intensity within said apertures is sufficient to effect stringing of the particles to prevent leakage thereof.

19. Apparatus according to claim 16 including a duct in which the bed is disposed and in which the electromechanical support means is mounted for spanning the entire cross-sectional area of the duct which is adapted to supply the gas that fluidizes the bed particles supported on the support means, and the field intensity is sufficient, in conjunction with the levitating effect of the gas flow on the particles, to prevent their leakage through the apertures in a region adjacent the edges thereof.

20. In a bed of semi-insulating particles supported by means containing an aperture with a size large in comparison with the size of the particles so that, normally, they would drop through the aperture under the influence of gravity in the absence of measures to prevent this from happening, the improvement which comprises means for creating, across the aperture, an electric field of such strength that particles making up the bed are prevented from passing through the aperture.

* * * * *